United States Patent [19]

Tsuboi et al.

[11] Patent Number: 4,951,638

[45] Date of Patent: Aug. 28, 1990

[54] SCREW TYPE MECHANICAL SUPERCHARGER

[75] Inventors: Noboru Tsuboi, Kakogawa; Kazuo Kubo, Kobe; Kunihiko Nishitani, Akashi, all of Japan

[73] Assignee: Kabushiki Kaisha Kobe Seiko Sho, Kobe, Japan

[21] Appl. No.: 299,461

[22] Filed: Jan. 23, 1989

[30] Foreign Application Priority Data

Jun. 29, 1988 [JP] Japan ..... 63-161549

[51] Int. Cl.[5] ..... F02B 33/36

[52] U.S. Cl. ..... 123/559.1; 418/201.1; 418/201.3

[58] Field of Search ..... 123/559.1; 418/197, 418/201.1, 201.3

[56] References Cited

U.S. PATENT DOCUMENTS 2,481,527 9/1949 Nilsson ..... 418/197
4,193,749 3/1980 Yamazaki et al. ..... 418/201 R
4,490,102 12/1984 Carre et al. ..... 418/201 R
4,504,203 3/1985 Bloemendal et al. ..... 418/201 B

*Primary Examiner*—Michael Koczo
*Attorney, Agent, or Firm*—Oblon, Spivak, McClelland, Maier & Neustadt

[57] ABSTRACT

Disclosed is a screw type mechanical supercharger which is small in size but has a large capacity. The supercharger includes a pair of female and male screw rotors held in a mutully meshing condition with each other, and a pair of synchronizing gears mounted for integral rotation with the screw rotors and held in meshing engagement with each other to establish synchronous rotation of the female and male screw rotors. The female rotor has six teeth while the male rotor has three teeth, and the synchronizing gear for the female rotor has a number of teeth equal to twice that of the other synchronizing gear for the male rotor. The female rotor is connected to be driven by a reciprocating internal combustion engine so as to serve as an input power shaft of the supercharger. The screw rotors are preferably formed from a lighter weight material than the remainder of the supercharger.

5 Claims, 2 Drawing Sheets

SCREW TYPE MECHANICAL SUPERCHARGER

BACKGROUND OF THE INVENTION

1. Field of the Invention

This invention relates to a screw type mechanical supercharger for use with a reciprocating internal combustion engine which is used, for example, for automobiles, marine vessels or general industries.

2. Description of the Prior Art

Such a screw type mechanical supercharger of the oil free type as shown in FIG. 3 is already known which is mechanically driven by way of a power transmitting mechanism including a gear, a belt or a chain by a crankshaft which is an output power shaft 10 of an engine (not shown).

Referring to FIG. 3, a body of the supercharger includes a pair of male and female screw rotors 11 and 12 held in a mutually meshing condition with each other with a small gap left therebetween without contacting with each other. The screw rotors 11 and 12 are connected to rotate in a synchronized relationship by a pair of synchronizing gears 13 and 14 which are mounted on ends of the rotor shafts and held in meshing engagement with each other.

A small gear 15 is mounted at the other end of the shaft of the male rotor 12 while a large gear 17 is mounted on an input power shaft 16 which is connected to be driven by the engine (not shown). The large gear 17 is held in meshing engagement with the small gear 15 so that the male rotor 12 may be driven by the engine (not shown). The female rotor 11 is thus driven in a synchronized relationship by the rotor 12 by way of the synchronizing gears 13 and 14.

A supercharger as described above commonly employs a combination of a male rotor having four or five teeth and a female rotor having six teeth.

With the supercharger described above, a driving force is transmitted via the input power shaft 16, large gear 17, small gear 15, male rotor 12, synchronizing gears 14 and 13 and female rotor 11 to rotate the two rotors 12 and 11, thereby to compress air sucked in from one side of the rotors 12 and 11 and forward or feed the compressed air from the other side of the rotors 12 and 11 into the engine.

It is a matter of importance to a supercharger applied, for example, to an automobile to minimize an increase in weight of the automobile or reduce the weight of the automobile and also to be of a small size because it is installed in an engine compartment.

Further, since an automobile is subjected to sudden acceleration or deceleration, follow-up is required for rotation of rotors of a supercharger. Consequently, a reduction in weight of the rotors is essential.

Meanwhile, although a supercharger is required to provide a compression pressure of about 2 kg·G/cm$^2$ from the characteristic thereof, it is required, in the case of a large vehicle such as a truck, to provide an amount of supercharged air on the order of about 10 m$^3$/min.

While it may seem preferable to raise the rotational speed of an input power shaft from an engine in order to increase the amount of supercharged air, the rotational speed of the engine itself cannot be raised freely from the efficiency characteristic of the engine. Also with such a mechanical supercharger to which power is transmitted from an engine by means of a belt or the like as disclosed in applicants' U.S. Pat. No. 4,826,412earlier, there occurs a problem in that the rotational speed of the engine cannot be raised freely due to a problem with the life of the belt or slipping of the belt during high speed transmission or the like.

SUMMARY OF THE INVENTION

It is an object of the present invention to provide a screw type mechanical supercharger which is small in size but has a large capacity.

In order to attain the object, according to one aspect of the present invention, there is provided a screw type mechanical supercharger which comprises a pair of female and male screw rotors held in a mutually meshing relationship with each other, and a pair of synchronizing gears mounted for integral rotation with the screw rotors and held in meshing engagement with each other to establish synchronous rotation of the female and male screw rotors, the female rotor having six teeth while the male rotor has three teeth, the synchronizing gear for the female rotor having a number of teeth twice that of the other synchronizing gear for the male rotor, and the female rotor being connected to be driven by a reciprocating internal combustion engine so as to serve as an input power shaft of the supercharger.

Preferably, the screw rotors are made of a lighter weight material than the remaining structure of the supercharger.

With the screw type mechanical supercharger, since the male rotor has three teeth and the female rotor has six teeth, the theoretical stroke volume of a compression chamber of the supercharger which is defined by the female and male rotors and an inner wall of a casing in which the female and male rotors are accommodated is increased, and accordingly, the discharge of the supercharger for each rotation is increased. In addition, since the supercharger is driven by the female rotor thereof, the rotational speeds of the rotors are increased, and accordingly, a large amount of discharge can be assured even where the rotors are comparatively small in size.

Further, since such conventional speed increasing gears as the large gear 17 and the small gear 15 described hereinabove with reference to FIG. 3 are eliminated and the ratio of the number of teeth between the synchronizing gears for the female and male sides is set to be 2:1, the supercharger can be reduced in terms of overall size and weight. Besides, since the female rotor side serves as an input power shaft of the supercharger, the synchronizing gears can attain the function of a speed increasing gear.

Accordingly, even where the supercharger has a similar rotor size as in a conventional supercharger, it can provide a greater amount of supercharged air.

In addition, where the screw rotors are formed from a lighter weight material, the supercharger can be further reduced in weight.

The above and other objects, features and advantages of the present invention will become apparent from the following description and the appended claims, taken in conjunction with the accompanying drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
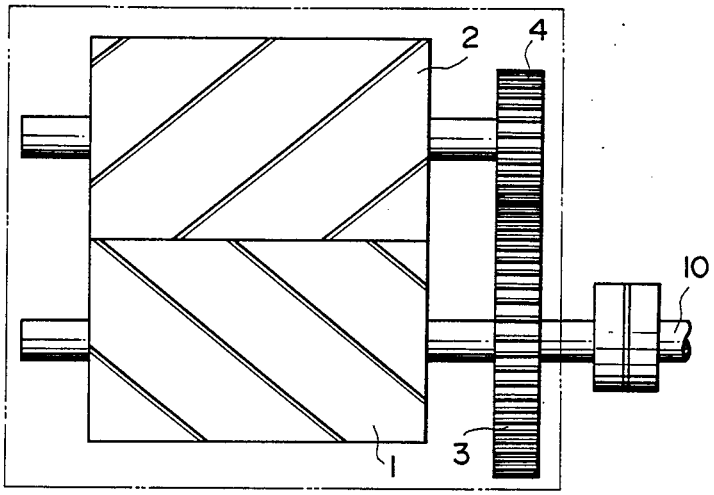
FIG. 1 is a schematic plan view illustrating a concept of a screw type mechanical supercharger according to the present invention.

Referring first to FIG. 1, there is illustrated a screw type mechanical supercharger of the oil free type according to the present invention. The screw type mechanical supercharger shown includes a pair of male and female screw rotors 1 and 2 accommodated in a casing (not shown) and held in a mutually meshing condition with each other with a small gap left therebetween, and a pair of synchronizing gears 3 and 4 mounted at one end of the rotors 1 and 2 and held in meshing engagement with each other so as to establish synchronized rotation of the rotors 1 and 2. A shaft of the female rotor 1 is connected to be driven to rotate by an engine (not shown). Thus, a driving force is transmitted in the order of the female rotor 1, synchronizing gear 3 for the female rotor 1, synchronizing gear 4 for the male rotor 2, and male rotor 2 to rotate the rotors in order to feed air in the manner as described hereinabove.

Figure 2:
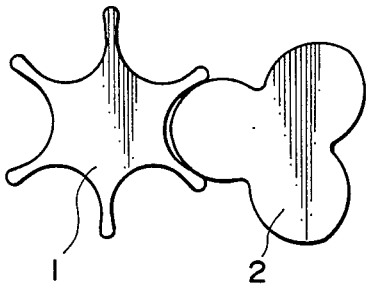
FIG. 2 is a side elevational view of screw rotors of the screw type mechanical supercharger of FIG. 1.

Referring now to FIG. 2, the female rotor 1 has six teeth while the male rotor 2 has three teeth. Accordingly, a compression chamber of the supercharger which is defined by the female and male rotors 1 and 2 has an increased capacity or volume, and the male rotor 2 on the driven side has a rotational speed equal to twice that of the female rotor 1. Therefore, also the synchronizing gear 3 on the female rotor 1 side has a number of teeth equal to twice that of the synchronizing gear 4 on the male rotor 2 side.

Figure 3:
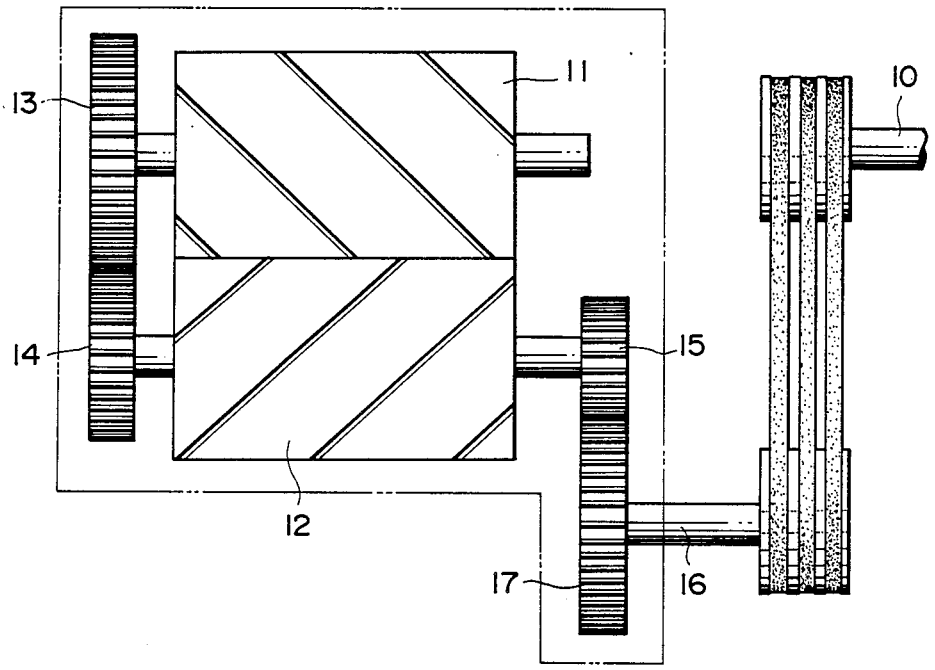
FIG. 3 PRIOR ART
FIG. 3 is a schematic plan view illustrating a conventional screw type mechanical supercharger.

In this manner, the synchronizing gears 3 and 4 in the supercharger are provided with a speed increasing function in addition to a synchronizing function. Accordingly, it is sufficient to provide gearing only at a single location as distinct from such a conventional supercharger as shown in FIG. 3, thereby enabling the entire device to be reduced in size and weight.

The rotors may be formed from a lighter weight material such as, for example, an aluminum alloy or an engineering plastic in order to further reduce the weight of the supercharger.

It is to be noted that it may seem preferable to increase the number of teeth of the female rotor 1 in order to increase the theoretical stroke volume, but the greater the number of such teeth, the smaller the thickness of each of the teeth. Where the number of teeth of the female rotor 1 is six, the teeth have a sufficient strength because the supercharger is required to provide a compression pressure of at most 2 kg·G/cm$^2$ as described hereinabove. However, where the number of teeth of the female rotor 1 exceeds six, the teeth will have a progressively reduced thickness and will be of insufficient strength.

While in the embodiment described above the shaft of the female rotor 1 is directly coupled to the output power shaft 10 of the engine, the present invention is not limited to the specific configuration, and where, for example, the output power shaft and the shaft of the female rotor 1 are otherwise offset, rotation may be transmitted between the two shafts by way of a suitable motion transmitting means such as, for example, a belt.

Obviously, numerous modifications and variations of the present invention are possible in light of the above teachings. It is therefore to be understood that within the scope of the appended claims, the invention may be practiced otherwise than as specifically described herein.

What is claimed is:

1. A screw type mechanical supercharger for an engine, which comprises:

a single pair of female and male screw rotors held in a mutually meshing condition with each other, a first and second synchronizing gear mounted for integral rotation with said female and male screw rotors, respectively, and rotatable with respect to each other to establish synchronous rotation of said female and male screw rotors, said female rotor being connected to said engine and having six teeth while said male rotor has three teeth, the first synchronizing gear for said female rotor having a number of teeth equal to twice that of the second synchronizing gear for said male rotor, and means for driving said female rotor such that said female rotor serves as an input power shaft of said supercharger.

2. A screw type mechanical supercharger according to claim 1, wherein said screw rotors are made of a material lighter in weight than the material of the remainder of said supercharger.

3. A screw type mechanical supercharger according to claim 1, which comprises an internal combustion engine connected to said female rotor.

4. A screw type mechanical supercharger according to claim 1, wherein said screw rotors are made of a material lighter in weight than the material of the remainder of said supercharger and which comprises an internal combustion engine connected to said female rotor.

5. A screw type mechanical supercharger according to claim 1, wherein said engine includes an output power shaft and which comprises means for directly coupling said female rotor to said output power shaft of said engine.

* * * * *